US007726845B2

(12) United States Patent
Zheng et al.

(10) Patent No.: US 7,726,845 B2
(45) Date of Patent: Jun. 1, 2010

(54) LED LAMP

(75) Inventors: Shi-Song Zheng, Shenzhen (CN); Yi-San Liu, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 17 days.

(21) Appl. No.: 11/967,066

(22) Filed: Dec. 29, 2007

(65) Prior Publication Data

US 2009/0168418 A1 Jul. 2, 2009

(51) Int. Cl.
*F21V 29/00* (2006.01)

(52) U.S. Cl. ..... 362/294; 362/145; 362/431

(58) Field of Classification Search ..... 362/373, 362/294, 547, 545, 431, 267, 311, 145, 153.1, 362/153, 800
See application file for complete search history.

(56) References Cited

U.S. PATENT DOCUMENTS 6,250,774 B1 * 6/2001 Begemann et al. ..... 362/231
6,942,361 B1 * 9/2005 Kishimura et al. ..... 362/240
7,329,030 B1 * 2/2008 Wang ..... 362/373
D573,741 S * 7/2008 Lou ..... D26/71
D573,743 S * 7/2008 Yan et al. ..... D26/71
D578,697 S * 10/2008 Zheng et al. ..... D26/71
7,434,959 B1 * 10/2008 Wang ..... 362/249.01
7,455,430 B2 * 11/2008 Huang ..... 362/294
7,480,038 B2 * 1/2009 Cohn et al. ..... 356/237.2
2008/0043479 A1 * 2/2008 Wang ..... 362/373
2008/0080188 A1 * 4/2008 Wang ..... 362/294
2009/0185374 A1 * 7/2009 Wu et al. ..... 362/249.06
2009/0303735 A1 * 12/2009 Chen ..... 362/373
2009/0323342 A1 * 12/2009 Liu ..... 362/249.02

FOREIGN PATENT DOCUMENTS

CN 101101102 A 1/2008
JP 2007-165051 A 6/2007

* cited by examiner

*Primary Examiner*—Jacob Y Choi
(74) *Attorney, Agent, or Firm*—Frank R. Niranjan

(57) ABSTRACT

An LED lamp includes a bracket, a heat sink assembly mounted on a top side of the bracket and a plurality of LED modules mounted on a bottom surface of the heat sink assembly. The heat sink assembly has a pair of bottom surfaces. The bottom surfaces form an alary configuration and the LED modules are mounted on the bottom surfaces.

6 Claims, 5 Drawing Sheets

LED LAMP

BACKGROUND OF THE INVENTION

1. Field of the Invention

The present invention relates to an LED lamp, more particularly to an LED lamp having a large illumination angle.

2. Description of Related Art

The technology of light emitting diodes has rapidly developed in recent years from indicators to illumination applications. With the features of long-term reliability, environment friendliness and low power consumption, the LED is viewed as a promising alternative for future lighting products.

A conventional LED lamp comprises a heat sink and a plurality of LED modules having LEDs attached to an outer surface of a heat sink to dissipate heat generated thereof. The outer surface of the heat sink generally is a plane and the LEDs are arranged close to each other. When the LED lamp works, the LEDs mounted on the plane outer surface of the heat sink only form a plane light source.

What is needed, therefore, is an LED lamp having a large illumination angle.

SUMMARY OF THE INVENTION

An LED lamp includes a bracket, a heat sink assembly mounted on a top side of the bracket and a plurality of LED modules mounted on a bottom surface of the heat sink assembly. The heat sink assembly has a pair of bottom surfaces. The bottom surfaces form an alary configuration and the LED modules are mounted on the bottom surfaces.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
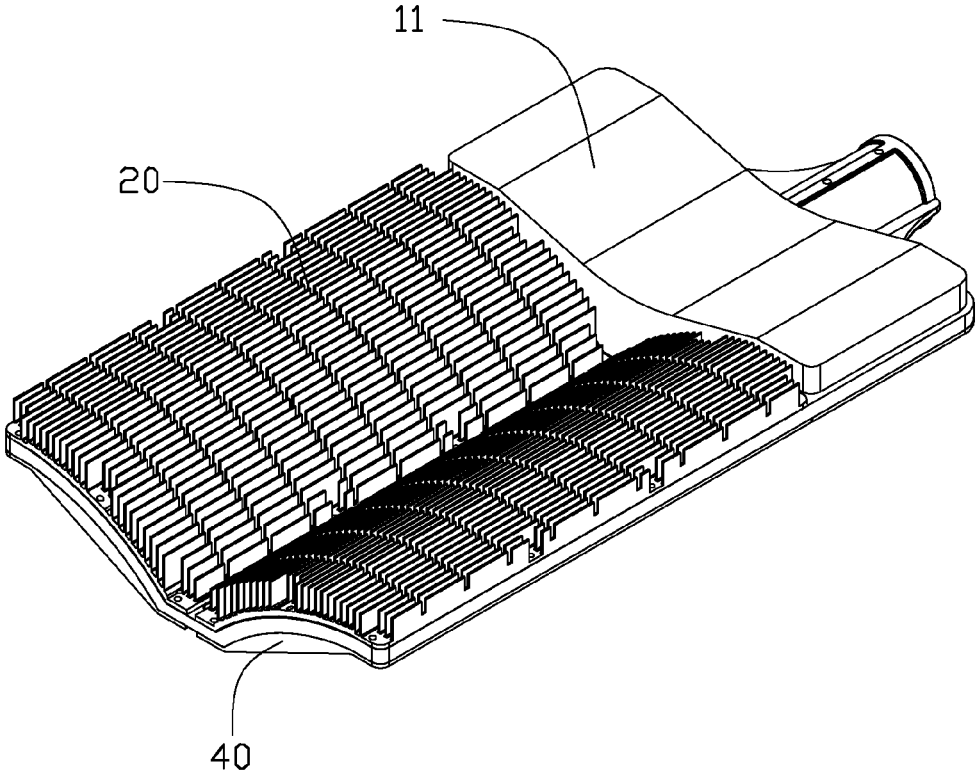
FIG. 1 is an assembled view of a lamp assembly in accordance with a preferred embodiment of the present invention.
Figure 2:
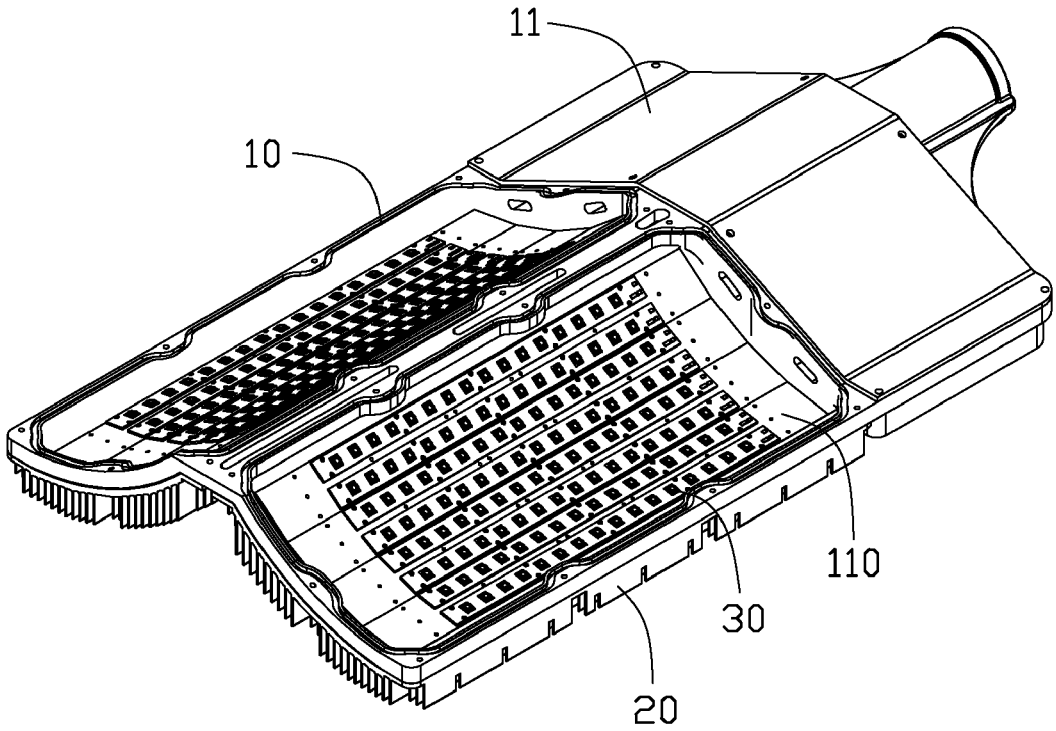
FIG. 2 is an inverted view of FIG. 1.

Referring to FIGS. 1-2, an LED lamp is alary and comprises a bracket (not labeled), a heat sink assembly (not labeled) mounted on a top side of the bracket, a pair of transparent lampshades 40 mounted on a bottom side of the bracket opposite to the heat sink assembly and a plurality of LED modules 30 mounted on a bottom surface of the heat sink assembly. The heat sink assembly comprises a pair of heat sinks 20.

Figure 3:
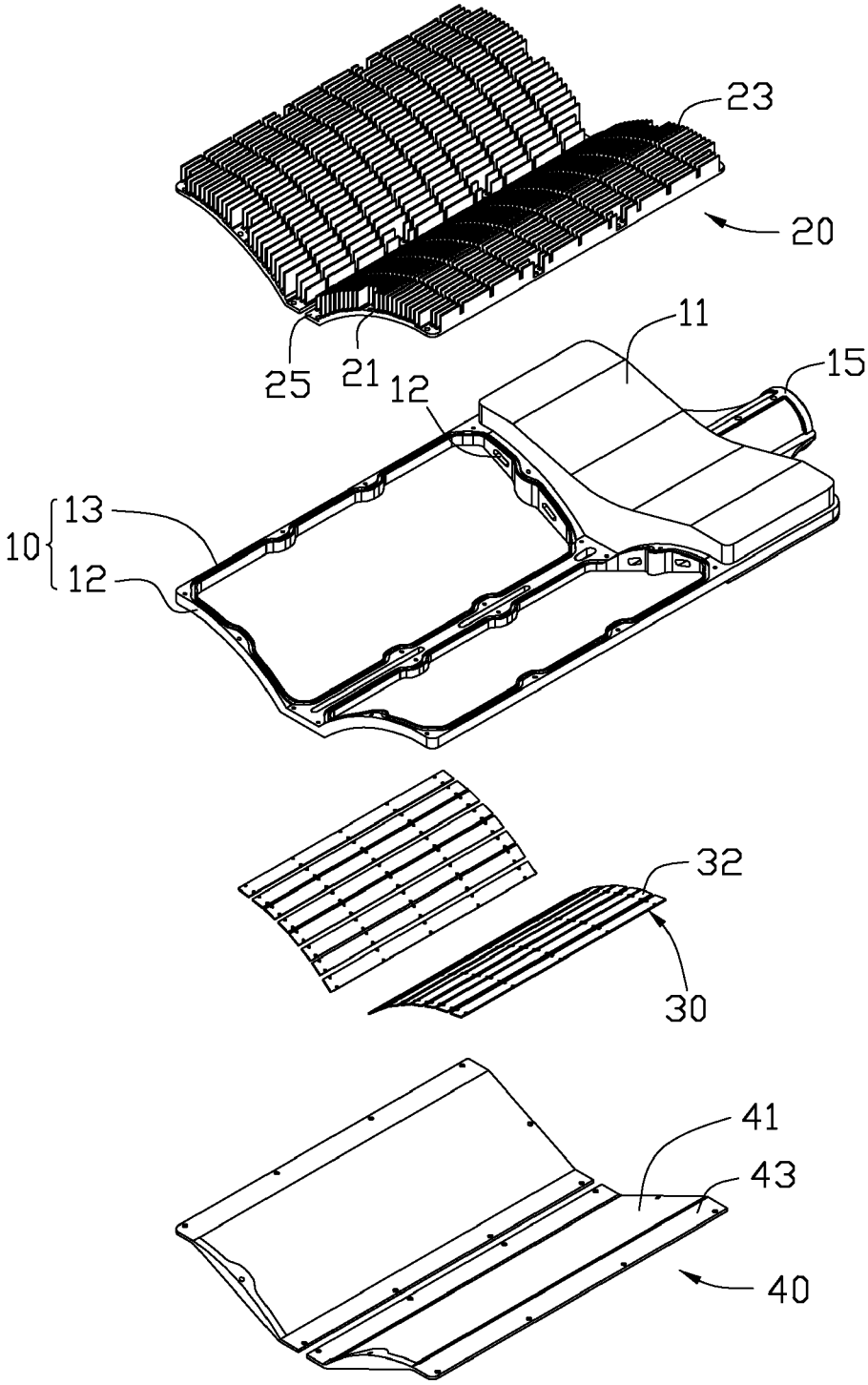
FIG. 3 is an exploded view of FIG. 1.
Figure 4:
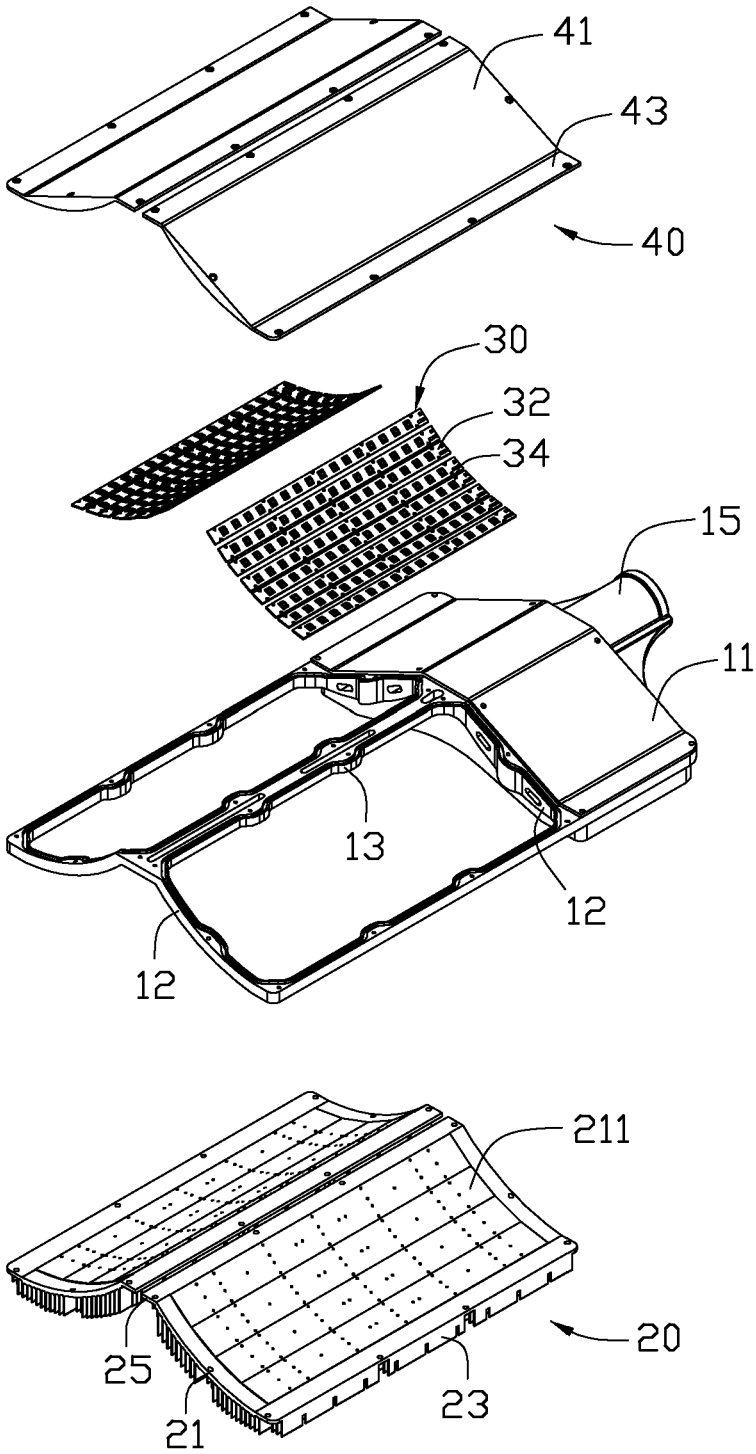
FIG. 4 is an exploded view of FIG. 2.

Referring to FIGS. 3-4 also, the bracket comprises two interconnected frames 10 having a configuration similar to that of the heat sink assembly and a receiving member 11 located at a rear end of the frames 10. Each of the frames 10 has a substantially rectangular configuration, and comprises two pairs of opposite sidewalls 12, 13 interconnected with each other. Each sidewall 13 is elongated and straight. Each sidewall 12 has an arc-shaped configuration. The sidewall 13 has a length larger than that of the sidewall 12. The two frames 10 connect with each other via two adjacent sidewalls 13 in such a manner that the two sidewalls 13 cooperatively act as a flat plate. Other parts of the two frames 10 except the flat plate extend outwardly and upwardly relative to the flat plate to form an alary configuration. The two heat sinks 20, the frame 10 and the lampshade 40 are assembled together to form a hermetical chamber 110. The LED modules 30 are received in the chambers 110. The receiving member 11 is located at a rear side of the chambers 10. A driving circuit module (not shown) is received in the receiving member 11 for electronically connecting with the LED modules 30. A fixture 15 is located at a central end of the receiving member 11. The fixture 15 is used for connecting the LED lamp to a supporting structure, such as a supporting post (not shown) of a lamp stand (not shown).

Figure 5:
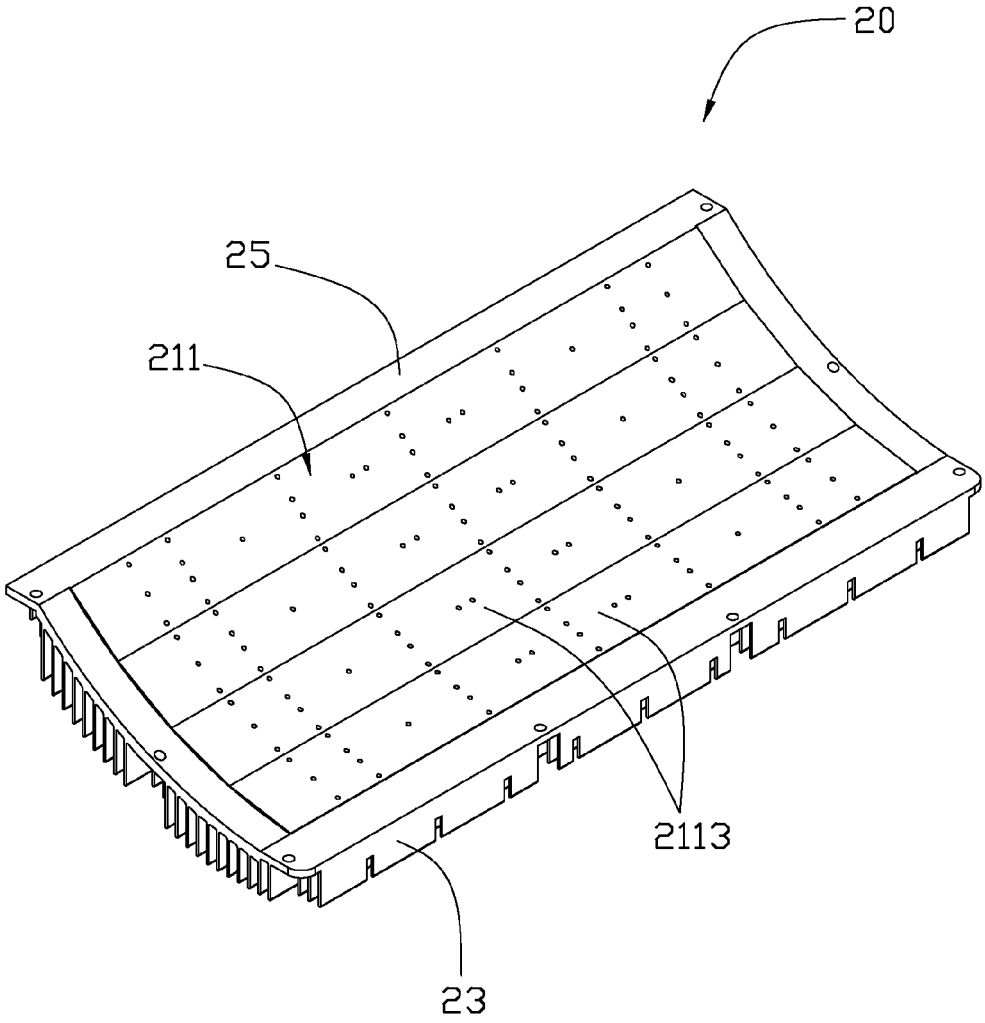
FIG. 5 is an enlarged view of a heat sink of FIG. 4.

Referring to FIG. 5 also, each heat sink 20 is made of high degree of heat conductivity material such as copper or aluminum. The heat sink 20 comprises an elongated mounting plate 25 and an arc-shaped base 21 extending slantwise and upwardly from a lateral side of the mounting plate 25. A plurality of mounting holes (not labeled) is defined in edges of the heat sink 20. A plurality of screws (not shown) extends through the mounting holes of the heat sinks 20 and engages with the frames 10 to mount the heat sinks 20 on the frames 10. The mounting plates 25 of the heat sinks 20 are aligned with each other and are mounted on the corresponding flat plate secured together. Thus, the frames 10 and the heat sinks 20 are assembled to have the alary configuration.

The base 21 has a concave bottom surface 211 and a vaulted top surface (not labeled) opposite to the bottom surface 211. A centre of the bottom surface 211 of the base 21 is divided into four elongated planar surfaces 2113 and the LED modules 30 are attached on the surfaces 2113. The surfaces 2113 are angled with each other. The surfaces 2113 and a bottom surface of the mounting plate 25 form acute inclined angles which are decreased along a transverse direction of the base 21. Thus, the LED lamp has a larger illumination angle than the conventional LED lamp. A plurality of fins 23 is formed on the top surface of the base 21.

Referring to FIG. 4 again, each LED module 30 comprises an elongated printed circuit board 32 and a plurality of spaced LEDs 34 evenly mounted on a side of the printed circuit board 32. The LEDs 34 of each LED module 30 are arranged along a longitudinal direction of the printed circuit board 32. Each LED module 30 is mounted in a thermally conductive relationship with the surfaces 2113 of the bases 21 of the heat sinks 20.

Each of the lampshade 40 comprises an elongated transparent plate 41 spanning the LED modules 30 received in the corresponding chamber 110 and two mounting plates 43 extending outwardly from lateral sides of the transparent plate 41. Screws (not shown) extend through the mounting plates 43 and engage with the frame 10 of the bracket to mount the lampshade 40 on the bracket.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising a bracket;

a heat sink assembly mounted on a top side of the bracket; and a plurality of LED modules mounted on a bottom surface of the heat sink assembly;

wherein the heat sink assembly comprises a pair of bases and the bases extend slantwise and upwardly from a centre of the heat sink assembly to form an alary configuration, each of the bases has a concave bottom surface and a top surface opposite to the bottom surface, a plurality of fins extending upwardly from the top surface of the bottom surface; and wherein a centre of the bottom surface of each of the bases is divided into a plurality of elongated planar surfaces and the planar surfaces are angled with each other and the LED modules are attached on the planar surfaces.

2. The LED lamp as claimed in claim 1, wherein the heat sink assembly comprises a mounting plate and the bases extend from the mounting plate and the planar surfaces and a bottom surface of the mounting plate form acute inclined angles which decreased along a transverse direction of the bases.

3. The LED lamp as claimed in claim 1, wherein the bracket comprises a pair of frames and the bases of the heat sink assembly mounted on the frames.

4. The LED lamp as claimed in claim 3 further comprising a pair of lampshades and the heat sink assembly, the frames and the lampshades are assembled together to form two hermetical chamber and the LED modules are received in the chambers.

5. An LED lamp comprising a bracket;

a pair of heat sinks mounted on a top side of the bracket, each of the heat sinks has a base and the bases of the heat sinks forms an alary configuration and each of the bases has a concave bottom surface; and a plurality of LED modules mounted on a bottom surface of the heat sinks;

wherein each of the heat sinks further comprises a mounting plate, the base extending slantwise and upwardly from a lateral side of the mounting plate; and wherein a centre of the bottom surface of each of the bases is divided into a plurality of elongated planar surfaces and the planar surfaces are angled with each other and the LED modules are attached on the planar surfaces.

6. The LED lamp as claimed in claim 5, wherein the mounting plate, the planar surfaces and a bottom surface of the mounting plate form acute inclined angles and the angles are decreased along a transverse direction of the bases.

* * * * *